US010192566B1

(12) United States Patent
Bullough

(10) Patent No.: US 10,192,566 B1
(45) Date of Patent: Jan. 29, 2019

(54) NOISE REDUCTION IN AN AUDIO SYSTEM

(71) Applicant: Sorenson IP Holdings, LLC, Salt Lake City, UT (US)

(72) Inventor: Jeffrey Bullough, South Jordan, UT (US)

(73) Assignee: Sorenson IP Holdings, LLC, Salt Lake City, UT (US)

( * ) Notice: Subject to any disclaimer, the term of this patent is extended or adjusted under 35 U.S.C. 154(b) by 0 days.

(21) Appl. No.: 15/873,219

(22) Filed: Jan. 17, 2018

(51) Int. Cl.
*G10L 21/0216* (2013.01)
*H04R 3/00* (2006.01)

(52) U.S. Cl.
CPC ..... *G10L 21/0216* (2013.01); *H04R 3/005* (2013.01); *G10L 2021/02166* (2013.01); *H04R 2410/07* (2013.01)

(58) Field of Classification Search
None
See application file for complete search history.

(56) References Cited

U.S. PATENT DOCUMENTS

| | | | | |
|---|---|---|---|---|
| 6,594,367 | B1 | 7/2003 | Marash et al. | |
| 9,460,727 | B1 | 10/2016 | Jing et al. | |
| 2008/0226098 | A1 | 9/2008 | Haulick et al. | |
| 2009/0116658 | A1 | 5/2009 | An et al. | |
| 2011/0044460 | A1 | 2/2011 | Rung | |
| 2011/0103626 | A1* | 5/2011 | Bisgaard | H04R 3/005 381/313 |
| 2012/0148067 | A1 | 6/2012 | Petersen et al. | |
| 2012/0224715 | A1* | 9/2012 | Kikkeri | H04R 3/005 381/92 |
| 2012/0253798 | A1 | 10/2012 | Walters et al. | |
| 2013/0010982 | A1 | 1/2013 | Elko et al. | |
| 2013/0051577 | A1 | 2/2013 | Morcelli et al. | |
| 2014/0185826 | A1* | 7/2014 | Tawada | G10L 21/0232 381/94.1 |
| 2014/0270231 | A1* | 9/2014 | Dusan | G10L 25/90 381/74 |
| 2016/0336913 | A1* | 11/2016 | Kuruba Buchannagari | H03G 3/32 |
| 2018/0033447 | A1* | 2/2018 | Ramprashad | G10L 21/028 |

FOREIGN PATENT DOCUMENTS

WO 20090042385 A1 4/2009

OTHER PUBLICATIONS

Ziming Qi, Real-Time Adaptive Noise Cancellation for Automatic Speech Recognition in a Car Environment, Thesis, Massey University, School of Engineering and Advanced Technology, Auckland, New Zealand.

* cited by examiner

*Primary Examiner* — Paul Huber
(74) *Attorney, Agent, or Firm* — Maschoff Brennan

(57) ABSTRACT

According to one or more aspects of the present disclosure, operations may include obtaining multiple microphone signals derived from a microphone array that includes a multiple omnidirectional microphones. Each of the microphone signals may be derived from a different microphone of the microphone array. The operations may further include determining whether the microphone signals include noise, such as wind noise, based on two or more of the plurality of microphone signals. In addition, the operations may include generating an output signal based on a beamformed signal or a reduced-noise signal based on whether the microphone signals are determined to include noise.

20 Claims, 4 Drawing Sheets

NOISE REDUCTION IN AN AUDIO SYSTEM

FIELD

The embodiments discussed in the present disclosure are related to reduction of noise in an audio system.

BACKGROUND

Some audio systems include microphone arrays of two or more omnidirectional microphones configured to detect sound and produce audio signals based on the detected sound. The audio signals may be beamformed in some instances to generate a beamformed signal that creates a directional response with respect to the detected sound such that the microphone arrays may be used as part of directional microphone systems. However, directional microphone systems, including those that incorporate beamforming, may exacerbate noise, such as wind noise.

The subject matter claimed in the present disclosure is not limited to embodiments that solve any disadvantages or that operate only in environments such as those described above. Rather, this background is only provided to illustrate one example technology area where some embodiments described herein may be practiced.

SUMMARY

According to one or more aspects of the present disclosure, operations may include obtaining multiple microphone signals derived from a microphone array that includes a multiple omnidirectional microphones. Each of the microphone signals may be derived from a different microphone of the microphone array. The operations may further include determining whether the microphone signals include noise, such as wind noise, based on two or more of the plurality of microphone signals. In addition, the operations may include generating an output signal based on a beamformed signal or a reduced-noise signal based on whether the microphone signals are determined to include noise.

BRIEF DESCRIPTION OF THE DRAWINGS

Example embodiments will be described and explained with additional specificity and detail through the use of the accompanying drawings in which.

DESCRIPTION OF EMBODIMENTS

Figure 1:
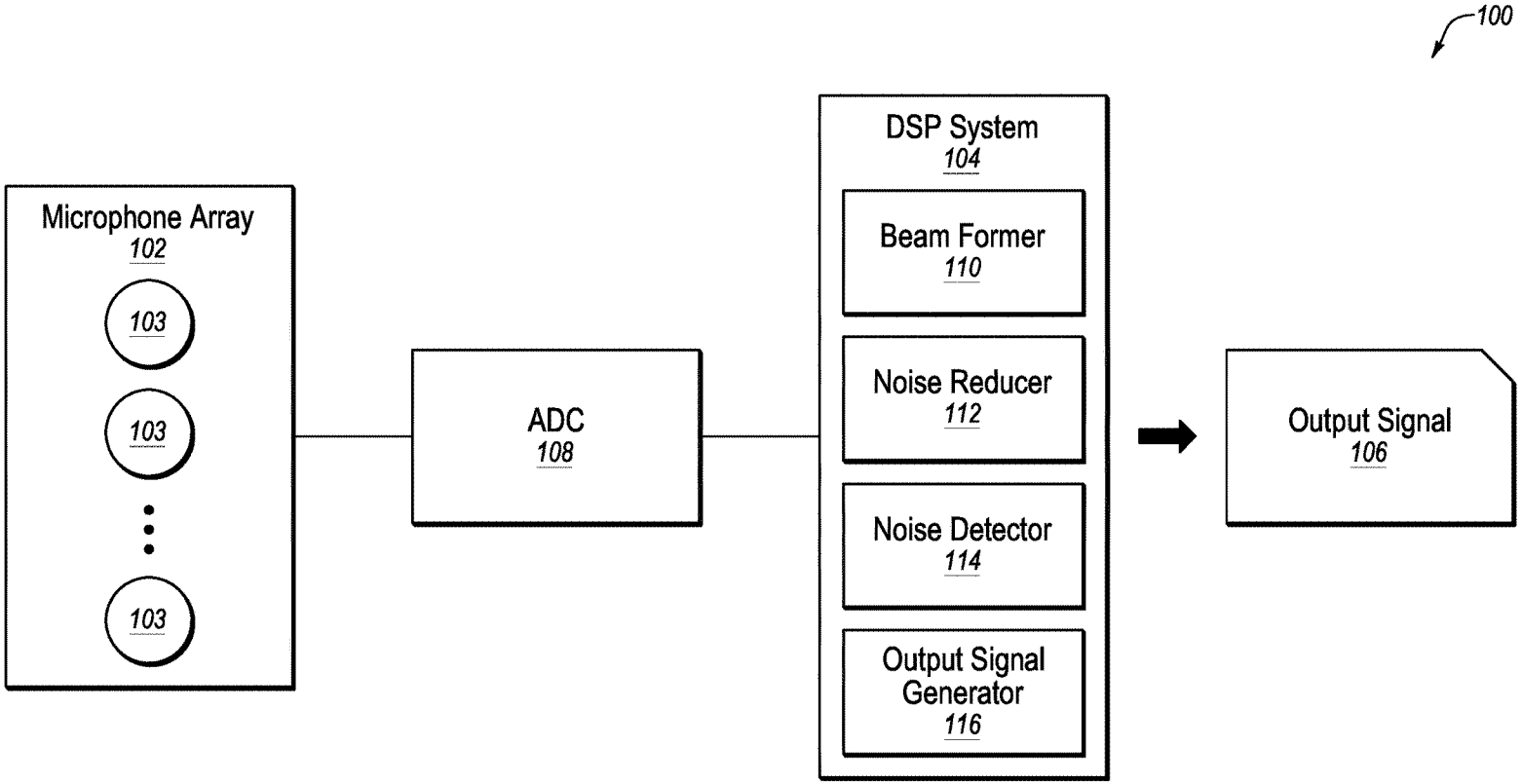
FIG. 1 illustrates an example directional microphone system configured to reduce noise.

In some instances, a directional microphone system may include an array of microphones. The array of microphones may include two or more omnidirectional microphones that are spaced apart according to a specified distance and that are each configured to detect sound and produce a corresponding audio signal (referred to as "microphone signals") based on the detected sound. Additionally or alternatively, the microphone signals produced by the omnidirectional microphones may be beamformed to generate a beamformed signal that may be used as the output signal of the directional microphone system. The beamforming may be configured to create a specific directional response with respect to the sound that may be detected by the omnidirectional microphones such that the beamformed signal may correspond to a particular direction that corresponds to the specific directional response.

For example, a directional response configured with respect to a front of the directional microphone system may be such that sound received at the rear of the directional microphone system may be attenuated with respect to sound received at the front. This may result in a higher signal-to-noise ratio (SNR) than omnidirectional microphones if the main signal of interest is arriving at the front of the directional microphone system and sounds arriving at locations other than the front are considered "noise." Directional microphone systems may thus improve sound quality in the presence of background noise especially when the background noise is coming from behind the microphone in instances in which the directional response corresponds to the front of the directional microphone systems. However, the operations performed during the beamforming may be such that some types of noise, such as wind noise, that may be detected by the array of microphones may be disproportionately amplified and exacerbated such that the SNR of the beamformed signal may be reduced when noise is present.

For example, turbulent airflow that may occur near the ports of microphones may be such that there may be differences in sound pressure levels at the different ports. The differences in sound pressure levels may result in the input received by the ports or the audio signals that may be generated having a relatively low correlation. Additionally, directional microphone systems may amplify and exacerbate noise that may create a relatively low correlation.

In the present disclosure, reference to "noise" may include any turbulent airflow at ports of a directional microphone system that may create signals or inputs with respect to the ports in which the signals or inputs may have a relatively low correlation with respect to each other. By way of example, the noise may be caused by wind blowing past the ports. As another example, the noise may be present as "puff sounds" that may be caused when a user speaks too close to a microphone, speaks loudly, or generates a lot of sound pressure when speaking, especially when speaking fricative sounds such as hard consonants.

According to one or more embodiments of the present disclosure, a directional microphone system that performs beamforming may be configured to reduce noise. For example, in some embodiments, it may be determined whether microphone signals that are generated by an array of omnidirectional microphones of the directional microphone system include noise. In response to determining that the microphone signals include noise, the directional microphone system may be configured to generate an output signal such that at least a portion of the output signal is not based on the beamformed signal.

For example, individual microphone signals that are generated by omnidirectional microphones typically are not affected by noise as much as beamformed signals. As such, in some embodiments, the at least portion of the output signal may be based on only one of the microphone signals that may be generated by one of the omnidirectional microphones of the microphone array instead of being based on the beamformed signal. In these or other embodiments, the at least portion of the output signal may be based on an averaged signal that includes an average of two or more of the microphone signals that may be generated by two or more of the omnidirectional microphones of the microphone array instead of being based on the beamformed signal.

Additionally or alternatively, in some embodiments, all of the output signal may be based on only one of the microphone signals or on the averaged signal. In these or other embodiments, the amount of the output signal that is not based on the beamformed signal may incrementally increase during the detection of the noise until none of the output signal is based on the beamformed signal. The incremental increase may be less noticeable by users to provide a better audio experience.

In these or other embodiments, in response to determining that the microphone signals no longer include noise, the output signal may be generated such that at least a portion of the output signal that was previously based on only one microphone signal or on the averaged signal may instead be based on the beamformed signal. Additionally or alternatively, the amount of the output signal that is based on the beamformed signal may incrementally increase after the noise ceases to be detected. In these or other embodiments, the incremental increase may be performed until all of the output signal is based on the beamformed signal after noise is no longer detected.

In the following description of the present disclosure in order to distinguish different types of audio signals that may be produced by a directional microphone system that includes an array of microphones, the different audio signals may be referred to as follows: the term "microphone signal" may identify an audio signal that may be generated by an individual microphone of a microphone array; the term "beamformed signal" may identify an audio signal that has been generated through performing beamforming operations with respect to two or more microphone signals; the term "averaged signal" may identify an audio signal that has been generated through performing averaging operations with respect to two or more microphone signals; and the term "output signal" may refer to an audio signal that may be output by the directional microphone system. As discussed in detail below, the output signal may be based on any number of different combinations of an individual microphone signal, a beamformed signal, and/or an averaged signal. Additionally, the term "audio signal" may include any type of signal that may include information that may represent sound. The audio signals may be analog signals, digital signals, or a combination of analog and digital signals.

Moreover, as used in this disclosure, the term audio may be used generically to refer to sounds that may include spoken words. Furthermore, the term "audio" may be used generically to include audio in any format, such as a digital format, an analog format, or a soundwave format. Furthermore, in the digital format, the audio may be compressed using different types of compression schemes.

Turning to the figures, FIG. 1 illustrates an example directional microphone system 100 ("system 100") configured to reduce noise. The system 100 may be arranged in accordance with one or more embodiments of the present disclosure.

In some embodiments, the system 100 may be included in an electronic device. The electronic device may include a desktop computer, a laptop computer, a smartphone, a mobile phone, a tablet computer, a telephone, a phone console, a server, a sound system, a television, or any other applicable electronic device. In some embodiments, the system 100 may include a microphone array 102, an analog to digital converter (ADC) 108, and a digital signal processing system 104 ("DSP system 104").

The microphone array 102 may include two or more microphones 103. Each of the microphones 103 may include any suitable system or device configured to detect sound and to generate a corresponding microphone signal based on the detected sound. In some embodiments, the microphone signals may be generated by the microphones 103 as analog signals. In some embodiments, the microphones 103 may be omnidirectional microphones that may have a same or substantially same response with respect to detecting sound in all directions. Additionally or alternatively, in some embodiments, the microphones 103 may be positioned and spaced with respect to each other in a known and/or specific manner. The spacing and positioning may be used to perform beamforming of the microphone signals as discussed in further detail below.

The ADC 108 may be configured to receive the microphone signals that may be generated by the microphones 103 and to convert the microphone signals from analog signals into digital signals. In some embodiments, the ADC 108 may be configured to individually receive each of the microphone signals and to individually convert each of the microphone signals into digital signals. Additionally, although the microphone signals have gone through a change by the ADC 108, for the purposes of the present disclosure, the digital microphone signals may still be considered as being generated by the microphones 103 in that they originally were derived from the microphones 103. The ADC 108 may include any suitable system, apparatus, or device that may be configured to convert analog signals to digital signals.

The DSP system 104 may be configured to receive the microphone signals that may be output by the ADC 108. The DSP system 104 may include any suitable system, apparatus, or device that may be configured to perform operations on the received microphone signals. For example, the DSP system 104 may include a computing system such as described below with respect to FIG. 2 that is configured to perform operations on the received microphone signals.

In some embodiments, the DSP system 104 may be configured to generate and output an output signal 106 based on the received microphone signals. As discussed in further detail below, the DSP system 104 may be configured to generate the output signal 106 such that noise in the output signal 106 may be reduced. In some embodiments, the DSP system may include a beamformer 110, a noise reducer 112, a noise detector 114, and an output signal generator 116, which as described below may each perform one or more operations related to generation of the output signal 106.

In some embodiments, the beamformer 110 may include computer readable instructions configured to enable a computing device to perform beamforming. Additionally or alternatively, the beamformer 110 may be implemented using hardware including a processor, a microprocessor (e.g., to perform or control performance of one or more operations), a field-programmable gate array (FPGA), or an application-specific integrated circuit (ASIC). In the present disclosure, operations described as being performed by the beamformer 110 may include operations that the beamformer 110 may perform itself or direct a corresponding system (e.g., the DSP system 104) to perform.

The beamformer 110 may be configured to receive the microphone signals and to perform beamforming with respect to two or more of the microphone signals. To perform the beamforming, the beamformer 110 may obtain the relative spacing and positioning of the microphones 103 with respect to each other. In addition, the beamformer 110 may be configured to perform any suitable phase shifting operations, summing operations (e.g., adding and/or subtracting), etc. with respect to two or more of the microphone signals based on the relative spacing and positioning of the corresponding microphones 103 during the beamforming of the microphone signals. The phase shifting, summing, etc. of the microphone signals may generate a beamformed signal with a particular directional response. The particulars regarding the phase shifting, summing, etc. may vary depending on the particular directional response that is to be achieved.

In some embodiments, the noise reducer 112 may include computer readable instructions configured to enable a computing device to perform operations with respect to the microphone signals as described below. Additionally or alternatively, the noise reducer 112 may be implemented using hardware including a processor, a microprocessor (e.g., to perform or control performance of one or more operations), a field-programmable gate array (FPGA), or an application-specific integrated circuit (ASIC). In the present disclosure, operations described as being performed by the noise reducer 112 may include operations that the noise reducer 112 may perform itself or direct a corresponding system (e.g., the DSP system 104) to perform.

The noise reducer 112 may be configured to receive the microphone signals and to perform operations with respect to the microphone signals. The operations may be such that the noise reducer 112 may generate a reduced-noise signal that may have reduced noise as compared to the beamformed signal that may be generated by the beamformer 110.

For example, as indicated above, the individual microphone signals that may be generated by the microphones 103 may be less susceptible to noise than the beamformed signals due to the omnidirectional nature of the microphones 103. As such, in some instances, the noise reducer 112 may be configured to generate the reduced-noise signal by selecting a single microphone signal as the reduced-noise signal.

In some embodiments, a determination as to which microphone signal to select may be based on the signal levels and/or the SNRs of the microphone signals. For example, the noise reducer 112 may be configured to select a microphone signal with a relatively high SNR and/or a relatively high signal level over one or more microphone signals with relatively low SNRs and/or relatively low signal levels. In some embodiments, the noise reducer 112 may be configured to select the microphone signal with the highest SNR, and/or the highest signal level. In some instances, SNR may be prioritized over signal level in making the selection. In these or other embodiments, signal level may be prioritized over SNR in making the selection. Additionally or alternatively, SNR and signal level may be given the same or similar priority in making the selection.

In some embodiments, the noise reducer 112 may be configured to determine a signal indicator for one or more individual microphone signals that may be based on a combination of the signal level and the SNR of each of the corresponding microphone signals. In some embodiments, the SNR may be weighted more than signal level in determining the signal indicator. In these or other embodiments, signal level may be weighted more than SNR in determining the signal indicator. Additionally or alternatively, SNR and signal level may be given the same or similar weight in determining the signal indicator. In these or other embodiments, the noise reducer 112 may be configured to select a microphone signal with a signal indicator with a relatively high rating. In these or other embodiments, the noise reducer 112 may be configured to select a microphone signal that has the signal indicator with the highest rating.

As another example, the noise reducer 112 may be configured to average two or more of the microphone signals and to use the resulting averaged signal as the reduced-noise signal. In these or other embodiments, the noise reducer 112 may average all of the microphone signals to generate the averaged signal that may be used as the reduced-noise signal. In some embodiments, the averaging may include a simple average in which a sample at a time "t" of each microphone signal involved in the averaging is added together. The averaging may include dividing the resulting sum by the number of samples that are added together. Additionally or alternatively, in some embodiments, the average may be a weighted average. In some embodiments, the noise reducer 112 may be configured to select which microphone signals to use in determining the average based on the SNRs, signal levels, and/or signal indicators of the microphone signals in a similar manner as described above with respect to selection of single microphone signal.

In some embodiments, the noise detector 114 may include computer readable instructions configured to enable a computing device to detect noise. Additionally or alternatively, the noise detector 114 may be implemented using hardware including a processor, a microprocessor (e.g., to perform or control performance of one or more operations), a field-programmable gate array (FPGA), or an application-specific integrated circuit (ASIC). In the present disclosure, operations described as being performed by the noise detector 114 may include operations that the noise detector 114 may perform itself or direct a corresponding system (e.g., the DSP system 104) to perform.

The noise detector 114 may be configured to receive the microphone signals and to determine whether the microphone signals include noise, such as wind noise. The noise detector 114 may be configured to determine whether the microphone signals include noise, such as wind noise, using any suitable technique. In the present disclosure, reference to whether noise is detected in the microphone signals may refer to a result from a determination as to whether the microphone signals include noise.

For example, in instances in which the microphone signals do not include noise, the microphone signals may be highly correlated with respect to each other. In contrast, in instances in which the microphone signal do include noise, the microphone signals may be weakly correlated with respect to each other. As such, in some embodiments, the noise detector 114 may be configured to determine a correlation between two or more of the microphone signals. In response to the correlation being relatively weak, the noise detector 114 may determine that the microphone signals include noise. In contrast, in response to the correlation being relatively strong, the noise detector 114 may determine that the microphone signals do not include noise.

In some embodiments, the noise detector 114 may be configured to determine whether or not the correlation is relatively strong or relatively weak based on a threshold correlation. For example, the noise detector 114 may be configured to determine that the correlation is relatively weak (and that the microphone signals consequently include noise) in response to the correlation being less than the correlation threshold. Conversely, the noise detector 114 may be configured to determine that the correlation is relatively strong (and that the microphone signals consequently do not include noise) in response to the correlation being greater than the correlation threshold. The correlation threshold may be determined using any suitable observational analysis to determine which degrees of correlation correspond to noise levels that may be acceptable or unacceptable. In some instances, the amount of noise that may be acceptable or unacceptable may be based on individual implementation parameters and specifications of individual implementation environments such that the correlation threshold may vary for different implementation environments.

The noise detector 114 may be configured to determine the correlation based on any suitable technique. For example, the noise detector 114 may be configured to determine a running average or root mean square (RMS) average of the samples of each microphone signal. The noise detector 114 may be configured to compare the averages of two or more microphone signals to determine how a similarity between the compared microphone signals. For example, the noise detector 114 may be configured to determine a difference between the averages of the different microphone signals. A relatively small difference may indicate a relatively strong correlation and a relatively large difference may indicate a relatively weak correlation. In this and other embodiments, the correlation threshold may be a threshold difference in which the correlation may be less than the correlation threshold when the determined difference is greater than the threshold difference and in which the correlation may be greater than the correlation threshold when the determined difference is less than the threshold difference.

As another example, in some embodiments, the noise detector 114 may be configured to perform a cross-correlation calculation or a coherence calculation on two or more of the microphone signals using any suitable technique. The determined result may indicate a degree of correlation between the corresponding microphone signals. In some embodiments, the determined result may then be compared to a corresponding correlation threshold to determine whether noise may be included in the microphone signals.

In some embodiments, the output signal generator 116 may include computer readable instructions configured to enable a computing device to generate the output signal 106. Additionally or alternatively, the output signal generator 116 may be implemented using hardware including a processor, a microprocessor (e.g., to perform or control performance of one or more operations), a field-programmable gate array (FPGA), or an application-specific integrated circuit (ASIC). In the present disclosure, operations described as being performed by the noise detector 114 may include operations that the noise detector 114 may perform itself or direct a corresponding system (e.g., the DSP system 104) to perform.

The output signal generator 116 may be configured to generate the output signal 106 based on the noise determination that may be made by the noise detector 114. For example, the output signal generator 116 may be configured to generate the output signal 106 based on the beamformed signal generated by the beamformer 110 and/or based on the reduced-noise signal generated by the noise reducer 112 depending on whether noise is detected in the microphone signals.

For example, in response to noise not being detected in the microphone signals, the output signal generator 116 may be configured to direct that the beamformed signal be used as the output signal 106. Conversely, in response to noise being detected in the microphone signals, the output signal generator 116 may be configured to direct that the reduced-noise signal be used as the output signal 106.

In some embodiments, the beamformer 110 may be configured to always generate the beamformed signal and the noise reducer 112 may be configured to always generate the reduced-noise signal. In these and other embodiments, the output signal generator 116 may be configured to select either the beamformed signal or the reduced-noise signal as the output signal 106 based on whether noise is detected in the microphone signals. Alternatively or additionally, in instances in which the output signal 106 is based solely on the beamformed signal (e.g., when no noise is detected), the output signal generator 116 may be configured to instruct the beamformer 110 to generate the beamformed signal and may instruct the noise reducer 112 to not generate the reduced-noise signal. Additionally or alternatively, in instances in which the output signal 106 is based solely on the reduced-noise signal (e.g., when noise is detected), the output signal generator 116 may be configured to instruct the beamformer 110 to not generate the beamformed signal and may instruct the noise reducer 112 to generate the reduced-noise signal.

In some embodiments, the output signal generator 116 may be configured to direct that the output signal 106 be based on a combination of the beamformed signal and the reduced-noise signal. For example, an abrupt change between using the beamformed signal as the output signal 106 and using the reduced noise signal as the output signal 106 may be noticeable and unpleasant to a listener who may hear audio that is generated based on the output signal 106. As such, in some embodiments to reduce or avoid noticeable changes in the output signal 106, the output signal generator 116 may be configured to generate the output signal 106 based on a combination of the beamformed signal and the reduced-noise signal.

For example, in some embodiments, in response to noise being detected in the microphone signals, the output signal generator 116 may be configured to generate the output signal 106 such that only a portion of the output signal 106 is based on the reduced-noise signal and such that the other portion of the output signal 106 is based on the beamformed signal. For instance, upon receiving an indication that the microphone signals include noise, the output signal generator 116 may be configured to generate the output signal 106 such that a minority percentage (e.g., 5%, 10%, 15%, 20%, 25%, 30%, 35%, 40%, 45%) of the output signal 106 may be based on the reduced-noise signal instead of the beamformed signal and such that the remaining portion of the output signal may be based on the beamformed signal.

In these or other embodiments, the output signal generator 116 may be configured to incrementally increase how much (e.g., the percentage) of the output signal 106 is based on the reduced-noise signal instead of the beamformed signal over a period of time during which noise is detected in the microphone signals. Additionally or alternatively, the output signal generator 116 may be configured to increase how much of the output signal 106 is based on the reduced-noise signal until all of the output signal 106 is based on the reduced-noise signal instead of the beamformed signal while the noise is still detected in the microphone signals.

The amount of time allocated to transition the output signal from being based on all of the beamformed signal to the output signal being based on all of the reduced-noise signal may vary depending on individual implementation parameters and specifications of a particular implementation environment, which may include user comfort specifications, user preferences, and/or specifications related to detectability of the transition by users. In some embodiments, the amount of time may be determined based on any suitable observational analysis that may indicate which lengths of time may be acceptable or unacceptable with respect to user comfort, preference, and/or detectability of the transition by users.

In these or other embodiments, in response to noise no longer being detected in the microphone signals, the output signal generator 116 may be configured to generate the output signal 106 such that a minority percentage of the output signal 106 is based on the beamformed signal instead of the reduced-noise signal. In these or other embodiments, the output signal generator 116 may be configured to incrementally increase how much (e.g., the percentage) of the output signal 106 is based on the beamformed signal instead of the reduced-noise signal over a period of time after noise is no longer detected in the microphone signals. Additionally or alternatively, the output signal generator 116 may be configured to increase how much of the output signal 106 is based on the beamformed signal until all of the output signal 106 is based on the beamformed signal instead of the reduced-noise signal after the noise is no longer detected in the microphone signals.

The amount of time allocated to transition the output signal from being based on all of the reduced-noise signal to the output signal being based on all of the beamformed signal may vary depending on individual implementation parameters and specifications of a particular implementation environment, which may include user comfort specifications, user preferences, and/or specifications related to detectability of the transition by users. In some embodiments, the amount of time may be determined based on any suitable observational analysis that may indicate which lengths of time may be acceptable or unacceptable with respect to user comfort, preference, and/or detectability of the transition by users.

The output signal generator 116 may be configured to generate the output signal 106 based on a combination of the beamformed signal and the reduced-noise signal according to any suitable technique. For example, in some embodiments, the output signal generator 116 may be configured to synchronize the beamformed signal and the reduced-noise signal and may combine both the beamformed signal and the reduced-noise signal to generate the output signal 106. In these or other embodiments, the amplitudes of the beamformed signal and the reduced-noise signal may be adjusted with respect to each other such that the amount of the output signal 106 that may be based on the beamformed signal as compared to the reduced-noise signal may be adjusted. For example, in an instance in which 20% of the output signal 106 is based on the beamformed signal and 80% of the output signal 106 is based on the reduced-noise signal, the amplitude of the reduced-noise signal may be four times that of the amplitude of the beamformed signal when combined to make the output signal 106.

The system 100 may thus be configured to reduce noise that may be included in output signals of directional microphone systems. The reduction in noise may improve the clarity of the audio associated with the output signals of directional microphone systems such that the directional microphone systems may be improved. Modifications, additions, or omissions may be made to the system 100 without departing from the scope of the present disclosure. For example, the system 100 may include other elements than those specifically listed. Additionally, the system 100 may be included in any number of different systems or devices. In addition, the delineation of operations and descriptions with respect to the beamformer 110, the noise reducer 112, the noise detector 114, and the output signal generator 116 is used to help facilitate the description of the present disclosure. As such, the operations described with respect to one or more of the beamformer 110, the noise reducer 112, the noise detector 114, and the output signal generator 116 may be performed by components that may not be categorized, organized, or differentiated in the manner described.

Figure 2:
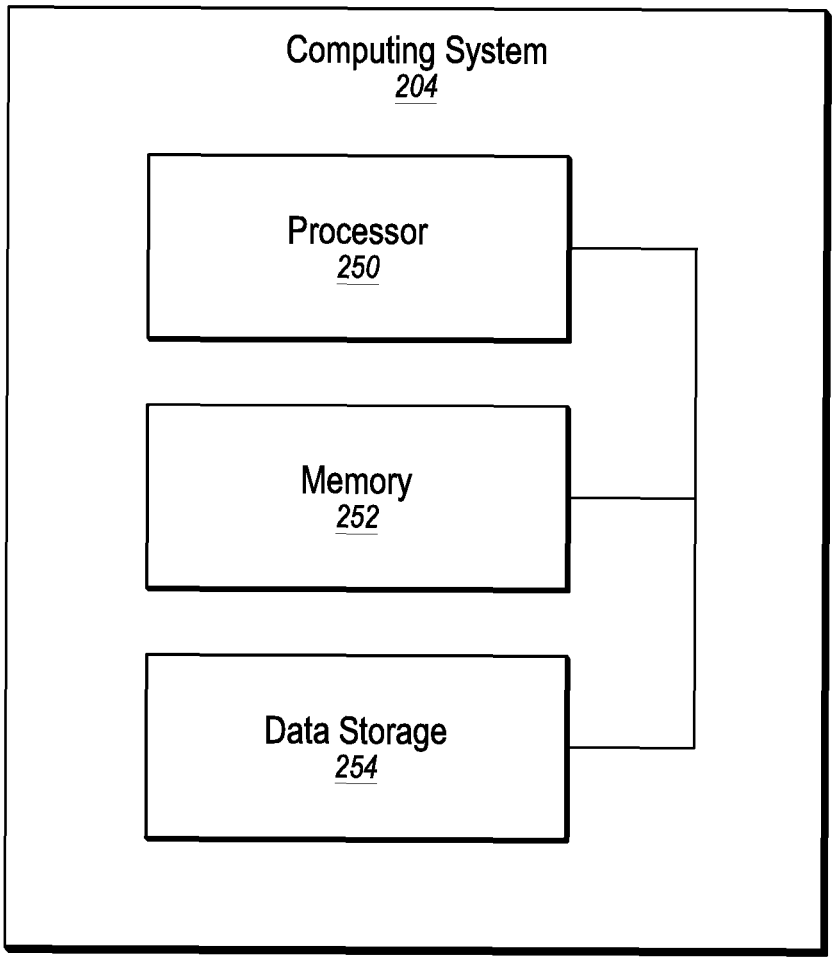
FIG. 2 illustrates a block diagram of an example computing system.

FIG. 2 illustrates a block diagram of an example computing system 204. The computing system 204 may be configured according to at least one embodiment of the present disclosure and may be configured to perform one or more operations related to reducing noise in directional microphone systems. One or more variations of the computing system 204 may be included in the DSP system 104 of FIG. 1. The computing system 204 may include a processor 250, a memory 252, and a data storage 254. The processor 250, the memory 252, and the data storage 254 may be communicatively coupled In general, the processor 250 may include any suitable special-purpose or general-purpose computer, computing entity, or processing device including various computer hardware or software modules and may be configured to execute instructions stored on any applicable computer-readable storage media. For example, the processor 250 may include a microprocessor, a microcontroller, a digital signal processor (DSP), an application-specific integrated circuit (ASIC), a Field-Programmable Gate Array (FPGA), or any other digital or analog circuitry configured to interpret and/or to execute program instructions and/or to process data. Although illustrated as a single processor in FIG. 2, the processor 250 may include any number of processors configured to, individually or collectively, perform or direct performance of any number of operations described in the present disclosure. Additionally, one or more of the processors may be present on one or more different electronic devices, such as different servers.

In some embodiments, the processor 250 may be configured to interpret and/or execute program instructions and/or process data stored in the memory 252, the data storage 254, or the memory 252 and the data storage 254. In some embodiments, the processor 250 may fetch program instructions from the data storage 254 and load the program instructions in the memory 252. After the program instructions are loaded into memory 252, the processor 250 may execute the program instructions.

For example, in some embodiments, a beamformer, a noise reducer, a noise detector, and/or an output signal generator such as the beamformer 110, the noise reducer 112, the noise detector 114, and/or the output signal generator 116 of FIG. 1 may be included in the data storage 254 as program instructions. The processor 250 may fetch the corresponding program instructions from the data storage 254 and may load the program instructions in the memory 252. After the program instructions of the beamformer, the noise reducer, the noise detector, and/or the output signal generator are loaded into memory 252, the processor 250 may execute the program instructions such that the computing system 204 may perform or direct the performance of the operations associated with the beamformer, the noise reducer, the noise detector, and/or the output signal generator as directed by the instructions.

The memory 252 and the data storage 254 may include computer-readable storage media for carrying or having computer-executable instructions or data structures stored thereon. Such computer-readable storage media may include any available media that may be accessed by a general-purpose or special-purpose computer, such as the processor 250. By way of example, and not limitation, such computer-readable storage media may include tangible or non-transitory computer-readable storage media including Random Access Memory (RAM), Read-Only Memory (ROM), Electrically Erasable Programmable Read-Only Memory (EE- PROM), Compact Disc Read-Only Memory (CD-ROM) or other optical disk storage, magnetic disk storage or other magnetic storage devices, flash memory devices (e.g., solid state memory devices), or any other storage medium which may be used to carry or store desired program code in the form of computer-executable instructions or data structures and which may be accessed by a general-purpose or special-purpose computer. In these and other embodiments, the term "non-transitory" as explained herein should be construed to exclude only those types of transitory media that were found to fall outside the scope of patentable subject matter in the Federal Circuit decision of In re Nuijten, 500 F.3d 1346 (Fed. Cir. 2007). Combinations of the above may also be included within the scope of computer-readable media.

Modifications, additions, or omissions may be made to the computing system 204 without departing from the scope of the present disclosure. For example, in some embodiments, the computing system 204 may include any number of other components that may not be explicitly illustrated or described.

Figure 3:
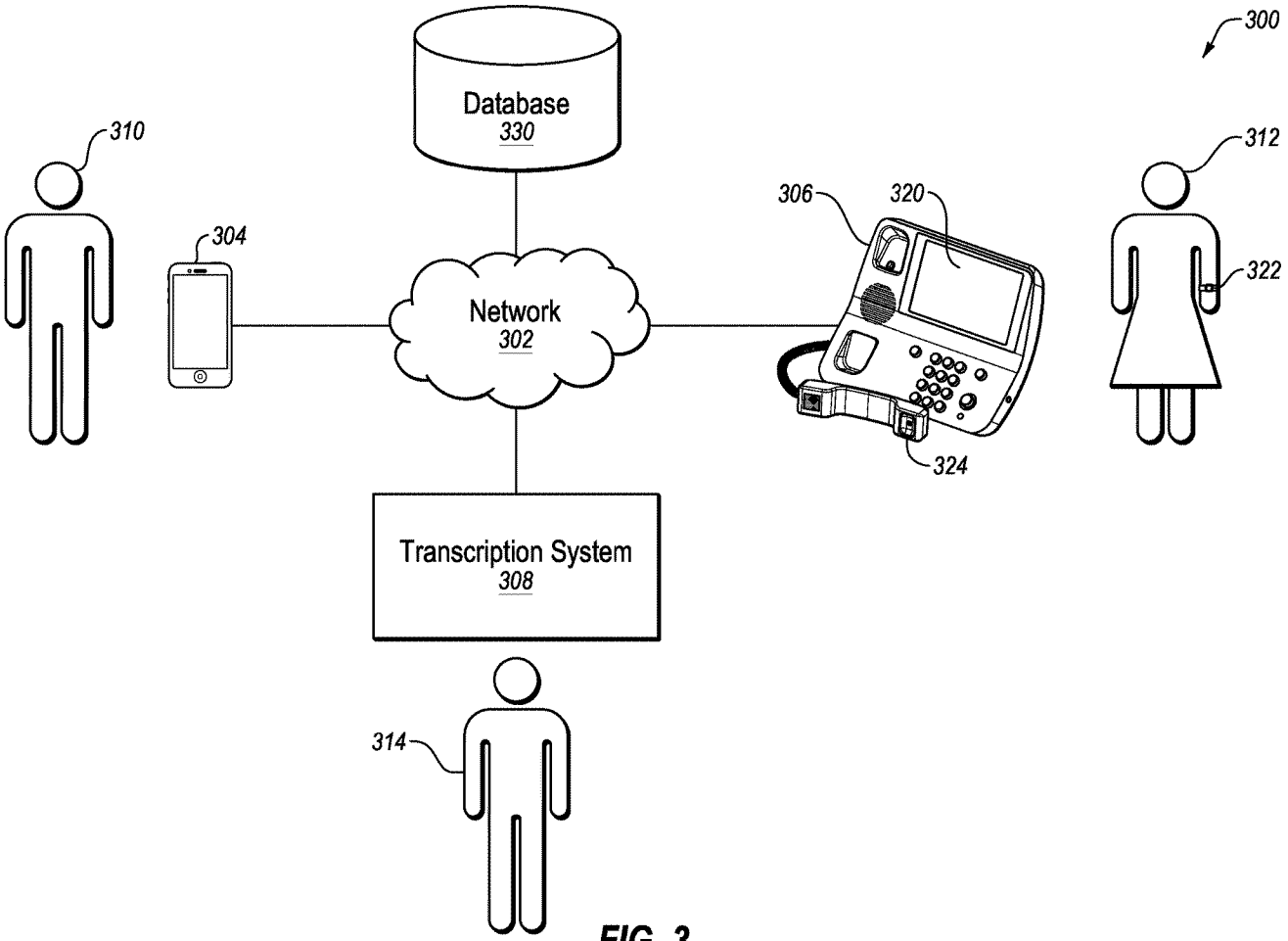
FIG. 3 illustrates an example environment for presentation of communications that may include noise reduction.

FIG. 3 illustrates an example environment 300 for presentation of communications that may include noise reduction. The environment 300 may be arranged in accordance with at least one embodiment described in the present disclosure. The environment 300 may include a network 302, a first device 304, a second device 306, a transcription system 308, and a database 330.

The network 302 may be configured to communicatively couple the first device 304, the second device 306, the transcription system 308, and the database 330. In some embodiments, the network 302 may be any network or configuration of networks configured to send and receive communications between systems and devices. In some embodiments, the network 302 may include a conventional type network, a wired or wireless network, and may have numerous different configurations. In some embodiments, the network 302 may also be coupled to or may include portions of a telecommunications network, including telephone lines, for sending data in a variety of different communication protocols, such as a plain old telephone system (POTS).

Each of the first and second devices 304 and 306 may be any electronic or digital computing device. For example, each of the first and second devices 304 and 306 may include a desktop computer, a laptop computer, a smartphone, a mobile phone, a tablet computer, a telephone, a phone console, a caption device, a captioning telephone, or any other computing device.

In some embodiments, each of the first device 304 and the second device 306 may include memory and at least one processor, which are configured to perform operations as described in this disclosure, among other operations. In some embodiments, each of the first device 304 and the second device 306 may include computer-readable instructions that are configured to be executed by each of the first device 304 and the second device 306 to perform operations described in this disclosure. For example, in some embodiments, the first device 304 and the second device 306 may each include a computing system such as the computing system 204 of FIG. 2.

Additionally or alternatively, in some embodiments, the first device 304 and/or the second device 306 may each include a directional microphone system. In these or other embodiments, the directional microphone system included in the first device 304 and/or the second device 306 may be configured to reduce noise. For example, the first device 304 and/or the second device 306 may include the directional microphone system 100 of FIG. 1 in some embodiments.

In some embodiments, each of the first and second devices 304 and 306 may be configured to establish communication sessions with other devices. For example, each of the first and second devices 304 and 306 may be configured to establish an outgoing communication session, such as a telephone call, video call, or other communication session, with another device over a telephone line or network. For example, each of the first device 304 and the second device 306 may communicate over a wireless cellular network, a wired Ethernet network, or a POTS line. Alternatively or additionally, each of the first device 304 and the second device 306 may communicate over other wired or wireless networks that do not include or only partially include a POTS. For example, a communication session between the first device 304 and the second device 306, such as a telephone call, may be a voice-over Internet protocol (VOIP) telephone call. As another example, the communication session between the first device 304 and the second device 306 may be a video communication session or other communication session.

In these or other embodiments, the directional microphone systems of the first device 304 and/or the second device 306 may be configured to detect sounds associated with the communication session (e.g., words spoken by participants in the communication session) and generate corresponding audio signals. In some embodiments, the directional microphone systems may be configured to reduce noise in the generated audio signals as described above with respect to FIG. 1.

Alternately or additionally, each of the first and second devices 304 and 306 may be configured to communicate with other systems over a network, such as the network 302 or another network. In these and other embodiments, each of the first device 304 and the second device 306 may receive data from and send data to the transcription system 308.

In some embodiments, the transcription system 308 may include any configuration of hardware, such as processors, servers, and database servers that are networked together and configured to perform a task. For example, the transcription system 308 may include multiple computing systems, such as multiple servers that each include memory and at least one processor, which are networked together and configured to perform operations of captioning communication sessions, such as telephone calls, between devices such as the second device 306 and another device as described in this disclosure. In these and other embodiments, the transcription system 308 may operate to generate transcriptions of audio of one or more parties in a communication session. For example, the transcription system 308 may generate transcriptions of audio generated by other devices and not the second device 306 or both the second device 306 and other devices, among other configurations.

In some embodiments, the transcription system 308 may operate as an exchange configured to establish communication sessions, such as telephone calls, video calls, etc., between devices such as the second device 306 and another device or devices as described in this disclosure, among other operations. In some embodiments, the transcription system 308 may include computer-readable instructions that are configured to be executed by the transcription system 308 to perform operations described in this disclosure.

Further, in some embodiments, the environment 300 may be configured to facilitate an assisted communication session between a hearing-impaired user 312 and a second user, such as a user 310. As used in the present disclosure, a "hearing-impaired user" may refer to a person with diminished hearing capabilities. Hearing-impaired users often have some level of hearing ability that has usually diminished over a period of time such that the hearing-impaired user can communicate by speaking, but that the hearing-impaired user often struggles in hearing and/or understanding others.

In some embodiments, the assisted communication session may be established between the first device 304 and the second device 306. In these embodiments, the second device 306 may be configured to present transcriptions of the communication session to the hearing-impaired user 312. As an example, the second device 306 may be one of the CaptionCall® 57T model family or 67T model family of captioning telephones or a device running the CaptionCall® mobile app. For example, in some embodiments, the second device 306 may include a visual display 320, such as a touchscreen visual display or other visual display, that is integral with the second device 306 and that is configured to present text transcriptions of a communication session to the hearing-impaired user 312.

Alternatively or additionally, the second device 306 may be associated with a visual display that is physically separate from the second device 306 and that is in wireless communication with the second device 306, such as a visual display of a wearable device 322 worn on the wrist of the hearing-impaired user 312 and configured to be in BlueTooth® wireless communication with the second device 306. Other physically separate physical displays may be visual displays of desktop computers, laptop computers, smartphones, mobile phones, tablet computers, or any other computing devices that are in wireless communication with the second device 306.

The second device 306 may also include a speaker 324, such as a speaker in a handset or a speaker in a speakerphone. The second device 306 may also include a processor communicatively coupled to the visual display 320 and to the speaker, as well as at least one non-transitory computer-readable media communicatively coupled to the processor and configured to store one or more instructions that when executed by the processor perform the methods for presentation of messages, and also store voice messages locally on the second device 306.

During a communication session, the transcription system 308, the first device 304, and the second device 306 may be communicatively coupled using networking protocols. In some embodiments, during the communication session between the first device 304 and the second device 306, the second device 306 may provide the audio received from the first device 304 to the transcription system 308. Alternatively or additionally, the first device 304 may provide the audio to the transcription system 308 and the transcription system 308 may relay the audio to the second device 306. Alternatively or additionally, video data may be provided to the transcription system 308 from the first device 304 and relayed to the second device 306.

At the transcription system 308, the audio data may be transcribed. In some embodiments, to transcribe the audio data, a transcription engine may generate a transcription of the audio. Alternatively or additionally, a remote call assistant 314 may listen to the audio received from the first device 304 at the transcription system 308, via the second device 306, and "revoice" the words of the user 310 to a speech recognition computer program tuned to the voice of the remote call assistant 314. In some embodiments, the reduction of noise may help facilitate the listening by the remote call assistant 314 for the revoicing of the words. In these and other embodiments, the remote call assistant 314 may be an operator who serves as a human intermediary between the hearing-impaired user 312 and the user 310. In some embodiments, text transcriptions may be generated by a speech recognition computer as a transcription of the audio of the user 310.

After generation of the text transcriptions, the text transcriptions may be provided to the second device 306 over the network 302. The second device 306 may display the text transcriptions on the visual display 320 while the hearing-impaired user 312 carries on a normal conversation with the user 310. The text transcriptions may allow the hearing-impaired user 312 to supplement the voice signal received from the first device 304 and confirm her understanding of the words spoken by the user 310. The transcription of a communication session occurring in real-time between two devices as discussed above may be referred to in this disclosure as a transcription communication session.

In addition to generating transcriptions of communication sessions, the environment 300 may be configured to provide transcriptions of communications from other devices, such as the first device 304. The communications may be messages, such as video messages or audio messages. The communications may be stored locally on the second device 306 or on a database 330.

As used in this disclosure, the term video may be used generically to refer to a compilation of images that may be reproduced in a sequence to produce video. Furthermore, the term "video" may be used generically to include video in any format. Furthermore, the video may be compressed using different types of compression schemes.

Modifications, additions, or omissions may be made to the environment 300 without departing from the scope of the present disclosure. For example, in some embodiments, the user 310 may also be hearing-impaired. In these and other embodiments, the transcription system 308 may provide text to the first device 304 based on audio transmitted by the second device 306. Alternately or additionally, the transcription system 308 may include additional functionality. For example, the transcription system 308 may edit the text or make other alterations to the text after presentation of the text on the second device 306. Alternately or additionally, in some embodiments, the environment 300 may include additional devices similar to the first and second devices 304 and 306. In these and other embodiments, the similar devices may be configured to present communications as described in this disclosure. Additionally, the environment 300 is merely an example of an environment in which noise reduction may be performed. However, the application of reducing noise as discussed in the present disclosure is not limited to implementations within environments such as the environment 300.

Figure 4:
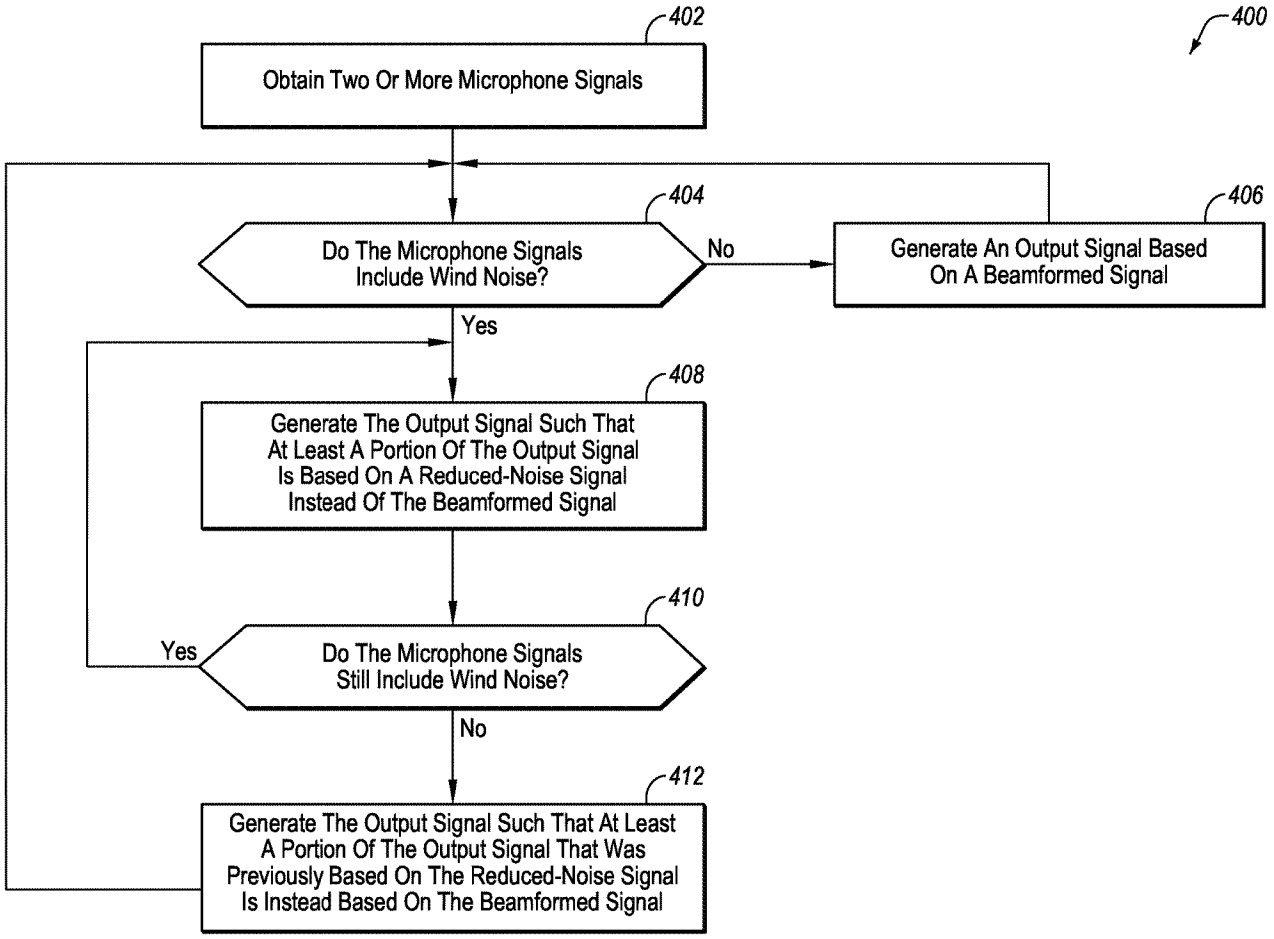
FIG. 4 is a flowchart of an example method to reduce noise.

FIG. 4 is a flowchart of an example method 400 to reduce noise. The method 400 may be arranged in accordance with at least one embodiment described in the present disclosure. The method 400 may be implemented, in some embodiments, by the system 100 of FIG. 1. In some embodiments, the method 400 may result from operations performed by a system based on instructions stored in one or more computer-readable media. Although illustrated as discrete blocks, various blocks may be divided into additional blocks, combined into fewer blocks, or eliminated, depending on the particular implementation.

The method 400 may begin at block 402 where two or more microphone signals may be obtained. In some embodiments, the microphone signals may be derived from a microphone array. In these or other embodiments, the microphone array may include two or more omnidirectional microphones that are each configured to generate a microphone signal such that each of the microphone signals may be derived from a different microphone of the microphone array. In some embodiments, obtaining the microphone signals may include receiving the microphone signals after they have been generated by the microphone array. In these or other embodiments, obtaining the microphone signals may include generating the microphone signals.

At block 404, it may be determined whether the microphone signals include noise. In some embodiments, the determination may be made based on two or more of the microphone signals. In these or other embodiments, the determination may be made based on a comparison between the two or more microphone signals. Additionally or alternatively, the comparison may be used to determine a correlation between the microphone signals and the correlation may be used to determine whether the microphone signals include noise. In some embodiments, the determination may be made such as described above with respect to FIG. 3.

At block 406, in response to determining the microphone signals do not include noise, an output signal may be generated based on only the beamformed signal. For example, in some embodiments, the beamformed signal may be used as the output signal. Following block 406, the method 400 may return to block 404. The beamformed signal may be based on beamforming of two or more of the of microphone signals as described above.

At block 408, in response to determining the microphone signals include noise, the output signal may be generated such that at least a portion of the output signal is based on a reduced-noise signal instead of the beamformed signal. In these or other embodiments, the reduced-noise signal may be based on an averaging of two or more of the microphone signals or may be based on only one of the plurality of microphone signals as described above.

In some embodiments, the reduced-noise signal may be selected as all of the output signal. In these or other embodiments, the output signal may be based on a combination of the beamformed signal and the reduced-noise signal at least for a limited period of time. For example, as described above, an amount of the output signal that is based on the reduced-noise signal instead of the beamformed signal may be incrementally increased over a period of time during which it is determined that the microphone signals include noise. Additionally or alternatively, the incremental increase may be performed until all of the output signal is based on the reduced-noise signal. In some embodiments, the incremental increase may be in response to the selection of the reduced-noise signal as all of the output signal such that the change to basing the output signal only on the reduced-noise signal (e.g., using only the reduced-noise signal as the output signal) may not be an abrupt change.

At block 410, it may be determined whether the microphone signals still include noise. In some embodiments, the determination may be made based on two or more updated microphone signals similar to the determination made in block 404. In response to the microphone signals still including noise, the method 400 may return to block 408. In response to the microphone signals no longer including noise, the method 400 may proceed to block 412.

At block 412, in response to determining the microphone signals no longer include noise, the output signal may be generated such that at least a portion of the output signal that was previously based on the reduced-noise signal is instead based on the beamformed signal. In some embodiments, the beamformed signal may be selected as all of the output signal in response to determining that the microphone signals no longer include noise. In these or other embodiments, the output signal may be based on a combination of the beamformed signal and the reduced-noise signal at least for a limited period of time. For example, in some embodiments, an amount of the output signal that is based on the beamformed signal instead of the reduced-noise signal may be incrementally increased over a period of time after which it is determined that the microphone signals no longer include noise. Additionally or alternatively, the incremental increase may be performed until all of the output signal is based on the beamformed signal. In some embodiments, the incremental increase may be in response to the selection of the beamformed signal as all of the output signal such that the change to basing the output signal only on the beamformed signal (e.g., using only the beamformed signal as the output signal) may not be an abrupt change. Following block 412, the method 400 may return to block 404.

Modifications, additions, or omissions may be made to method 400 without departing from the scope of the present disclosure. For example, the functions and/or operations described may be implemented in differing order than presented or one or more operations may be performed at substantially the same time. Additionally, one or more operations may be performed with respect to each of multiple virtual computing environments at the same time. Furthermore, the outlined functions and operations are only provided as examples, and some of the functions and operations may be optional, combined into fewer functions and operations, or expanded into additional functions and operations without detracting from the essence of the disclosed embodiments.

As indicated above, the embodiments described in the present disclosure may include the use of a special purpose or general purpose computer (e.g., the processor 250 of FIG. 2) including various computer hardware or software modules, as discussed in greater detail below. Further, as indicated above, embodiments described in the present disclosure may be implemented using computer-readable media (e.g., the memory 252 or data storage 254 of FIG. 2) for carrying or having computer-executable instructions or data structures stored thereon.

In some embodiments, the different components, modules, engines, and services described herein may be implemented as objects or processes that execute on a computing system (e.g., as separate threads). While some of the systems and methods described in the present disclosure are generally described as being implemented in software (stored on and/or executed by general purpose hardware), specific hardware implementations or a combination of software and specific hardware implementations are also possible and contemplated.

In accordance with common practice, the various features illustrated in the drawings may not be drawn to scale. The illustrations presented in the present disclosure are not meant to be actual views of any particular apparatus (e.g., device, system, etc.) or method, but are merely idealized representations that are employed to describe various embodiments of the disclosure. Accordingly, the dimensions of the various features may be arbitrarily expanded or reduced for clarity. In addition, some of the drawings may be simplified for clarity. Thus, the drawings may not depict all of the components of a given apparatus (e.g., device) or all operations of a particular method.

Terms used in the present disclosure and especially in the appended claims (e.g., bodies of the appended claims) are generally intended as "open" terms (e.g., the term "including" should be interpreted as "including, but not limited to," the term "having" should be interpreted as "having at least," the term "includes" should be interpreted as "includes, but is not limited to," etc.).

Additionally, if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations.

In addition, even if a specific number of an introduced claim recitation is explicitly recited, such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." or "one or more of A, B, and C, etc." is used, in general such a construction is intended to include A alone, B alone, C alone, A and B together, A and C together, B and C together, or A, B, and C together, etc. For example, the use of the term "and/or" is intended to be construed in this manner.

Further, any disjunctive word or phrase presenting two or more alternative terms, whether in the description, claims, or drawings, should be understood to contemplate the possibilities of including one of the terms, either of the terms, or both terms. For example, the phrase "A or B" should be understood to include the possibilities of "A" or "B" or "A and B."

Additionally, the use of the terms "first," "second," "third," etc., are not necessarily used in the present disclosure to connote a specific order or number of elements. Generally, the terms "first," "second," "third," etc., are used to distinguish between different elements as generic identifiers. Absence a showing that the terms "first," "second," "third," etc., connote a specific order, these terms should not be understood to connote a specific order. Furthermore, absence a showing that the terms first," "second," "third," etc., connote a specific number of elements, these terms should not be understood to connote a specific number of elements. For example, a first widget may be described as having a first side and a second widget may be described as having a second side. The use of the term "second side" with respect to the second widget may be to distinguish such side of the second widget from the "first side" of the first widget and not to connote that the second widget has two sides.

All examples and conditional language recited in the present disclosure are intended for pedagogical objects to aid the reader in understanding the invention and the concepts contributed by the inventor to furthering the art, and are to be construed as being without limitation to such specifically recited examples and conditions. Although embodiments of the present disclosure have been described in detail, it should be understood that the various changes, substitutions, and alterations could be made hereto without departing from the spirit and scope of the present disclosure.

What is claimed is:

1. A system comprising:

a microphone array that includes a plurality of omnidirectional microphones, each of the plurality of microphones being configured to produce a microphone signal based on sound detected by the corresponding microphone such that the microphone array produces a plurality of microphone signals; and a computing system communicatively coupled to the microphone array and configured to perform operations, the operations comprising:

generate a beamformed signal by beamforming two or more of the plurality of microphone signals;

generate an averaged signal by averaging two or more of the plurality of microphone signals;

determine that the plurality of microphone signals include noise based on two or more of the plurality of microphone signals; and generate an output signal such that at least a portion of the output signal is based on the averaged signal instead of the beamformed signal in response to determining that the plurality of microphone signals include noise.

2. The system of claim 1, wherein the operations further comprise increasing, over a period time during which it is determined that the plurality of microphone signals include noise, how much of the output signal is based on the averaged signal instead of the beamformed signal.

3. The system of claim 1, wherein all of the output signal is based on the averaged signal instead of the beamformed signal in response to determining that the plurality of microphone signals include noise.

4. The system of claim 1, wherein the operations further comprise:

determine, after determining that the plurality of microphone signals include noise, that the plurality of microphone signals no longer include noise; and generate the output signal such that all of the output signal is based on the beamformed signal in response to determining that the plurality of microphone signals no longer include noise.

5. The system of claim 4, wherein the operations further comprise increasing, over a period time after which it is determined that the plurality of microphone signals no longer include noise, how much of the output signal is based on the beamformed signal instead of the averaged signal until all of the output signal is based on the beamformed signal.

6. The system of claim 1, wherein averaging the two or more of the plurality of microphone signals includes averaging samples of the two or more of the plurality of microphone signals.

7. The system of claim 1, wherein determining that the plurality of microphone signals include noise based on two or more of the plurality of microphone signals is based on a correlation between the two or more of the plurality of microphone signals.

8. A system comprising:

one or more computer-readable storage media configured to store instructions; and one or more processors configured to execute the instructions, wherein execution of the instructions causes the system to perform operations comprising:

obtain a plurality of microphone signals derived from a microphone array that includes a plurality of omnidirectional microphones, each of the plurality of microphone signals being derived from a different microphone of the microphone array;

determine that the plurality of microphone signals include noise based on two or more of the plurality of microphone signals; and generate an output signal such that at least a portion of the output signal is based on an averaged signal instead of a beamformed signal in response to determining that the plurality of microphone signals include noise, the beamformed signal is based on beamforming of two or more of the plurality of microphone signals and the averaged signal is based on an averaging of two or more of the plurality of microphone signals.

9. The system of claim 8, wherein the operations further comprise increasing, over a period time during which it is determined that the plurality of microphone signals include noise, how much of the output signal is based on the averaged signal instead of the beamformed signal.

10. The system of claim 8, wherein all of the output signal is based on the averaged signal instead of the beamformed signal in response to determining that the plurality of microphone signals include noise.

11. The system of claim 8, wherein the operations further comprise:

determine, after determining that the plurality of microphone signals include noise, that the plurality of microphone signals no longer include noise; and generate the output signal such that all of the output signal is based on the beamformed signal in response to determining that the plurality of microphone signals no longer include noise.

12. The system of claim 11, wherein the operations further comprise increasing, over a period time after which it is determined that the plurality of microphone signals no longer include noise, how much of the output signal is based on the beamformed signal instead of the averaged signal until all of the output signal is based on the beamformed signal.

13. The system of claim 8, wherein the operations further comprise:

generate the beamformed signal;

generate the averaged signal; and generate the output signal by selecting the averaged signal instead of the beamformed signal as the output signal.

14. The system of claim 8, wherein determining that the plurality of microphone signals include noise based on two or more of the plurality of microphone signals is based on a correlation between the two or more of the plurality of microphone signals.

15. A method comprising:

obtaining a plurality of microphone signals derived from a microphone array that includes a plurality of omnidirectional microphones, each of the plurality of microphone signals being derived from a different microphone of the microphone array;

determining that the plurality of microphone signals include noise based on two or more of the plurality of microphone signals; and selecting a reduced-noise signal instead of a beamformed signal as all of an output signal based on determining that the plurality of microphone signals include noise, the beamformed signal is based on beamforming of two or more of the plurality of microphone signals and the reduced-noise signal is based on an averaging of two or more of the plurality of microphone signals or is based on only one of the plurality of microphone signals.

16. The method of claim 15, further comprising increasing, over a period time during which it is determined that the plurality of microphone signals include noise, how much of the output signal is based on the reduced-noise signal instead of the beamformed signal until all of the output signal is based on the reduced-noise signal.

17. The method of claim 15, further comprising:

determining, after determining that the plurality of microphone signals include noise, that the plurality of microphone signals no longer include noise; and selecting the beamformed signal instead of the reduced-noise signal as all of the output signal in response to determining that the plurality of microphone signals no longer include noise.

18. The method of claim 15, further comprising increasing, over a period time after which it is determined that the plurality of microphone signals no longer include noise, how much of the output signal is based on the beamformed signal instead of the reduced-noise signal until all of the output signal is based on the beamformed signal.

19. The method of claim 15, wherein determining that the plurality of microphone signals include noise based on two or more of the plurality of microphone signals is based on a correlation between the two or more of the plurality of microphone signals.

20. At least one non-transitory computer-readable media configured to store one or more instructions that in response to being executed by at least one computing system cause performance of the method of claim 15.

* * * * *